US011220910B2

(12) United States Patent
Capron et al.

(10) Patent No.: US 11,220,910 B2
(45) Date of Patent: Jan. 11, 2022

(54) COMPRESSOR STATOR

(71) Applicant: PRATT & WHITNEY CANADA CORP., Longueuil (CA)

(72) Inventors: Alexandre Capron, Toronto (CA); Karan Anand, Mississauga (CA); Hien Duong, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 128 days.

(21) Appl. No.: 16/522,693

(22) Filed: Jul. 26, 2019

(65) Prior Publication Data

US 2021/0025277 A1 Jan. 28, 2021

(51) Int. Cl.
*F01D 5/14* (2006.01)
*F01D 9/04* (2006.01)
*F04D 29/54* (2006.01)

(52) U.S. Cl.
CPC ..... *F01D 5/141* (2013.01); *F01D 9/041* (2013.01); *F04D 29/544* (2013.01)

(58) Field of Classification Search
CPC . F01D 5/141; F01D 9/04; F01D 9/041; F04D 29/544
See application file for complete search history.

(56) References Cited

U.S. PATENT DOCUMENTS 5,326,221 A * 7/1994 Amyot ..... F01D 5/141 415/191
6,036,438 A * 3/2000 Imai ..... F01D 5/142 415/192
6,079,948 A * 6/2000 Sasaki ..... F04D 29/324 416/237
6,109,869 A * 8/2000 Maddaus ..... F01D 5/141 29/889.1
6,375,420 B1 * 4/2002 Tanuma ..... F01D 5/141 415/199.5
6,554,564 B1 4/2003 Lord
(Continued)

FOREIGN PATENT DOCUMENTS

EP 0661413 A1 * 7/1995 ..... F01D 5/141
EP 3165714 A1 5/2017

OTHER PUBLICATIONS

Thermix. Turbomachine Definition and Basic Information, http://www.thermix.net/2012/05/turbomachine-definition-and-basic.html May 2012 (Year: 2012).*

(Continued)

*Primary Examiner* — Topaz L. Elliott
(74) *Attorney, Agent, or Firm* — Norton Rose Fulbright Canada LLP

(57) ABSTRACT

A stator that has vanes extending between a first end and a second end along a span and from a leading edge to a trailing edge along a chord length, the vanes having a first end portion extending from the first end to about 30% of the span to a first location, a chord ratio of the chord length at the first end to the chord length at the first location greater than or equal to 1.1, a throat ratio of a width of a throat between two adjacent vanes at the first location to a width of the throat at the first end is greater than or equal to 1.3, a sweep angle difference between a maximum sweep angle of the leading edge along the first end portion and a minimum sweep angle of the leading edge along the first end portion is at least 15 degrees.

20 Claims, 4 Drawing Sheets

(56) References Cited

U.S. PATENT DOCUMENTS

| | | | | |
|---|---|---|---|---|
| 8,221,065 | B2 * | 7/2012 | Greim | F01D 5/141 415/192 |
| 8,602,727 | B2 * | 12/2013 | Bahadur | F01D 9/041 415/192 |
| 9,441,502 | B2 * | 9/2016 | Gbadebo | F01D 25/162 |
| 9,752,439 | B2 | 9/2017 | Gallagher et al. | |
| 10,578,125 | B2 * | 3/2020 | Duong | F04D 29/542 |
| 10,808,535 | B2 * | 10/2020 | Haller | F01D 5/143 |
| 2008/0152505 | A1 * | 6/2008 | Burton | F01D 5/141 416/223 R |
| 2012/0183411 | A1 * | 7/2012 | Haller | F01D 9/041 416/243 |
| 2017/0097011 | A1 | 4/2017 | Pallot et al. | |
| 2017/0130587 | A1 * | 5/2017 | Bhaumik | F01D 5/141 |
| 2018/0142703 | A1 * | 5/2018 | Duong | F01D 5/141 |
| 2018/0283190 | A1 * | 10/2018 | Jaiswal | F01D 9/041 |

OTHER PUBLICATIONS

European Search Report issued in counterpart EP application No. 20187760.2 dated Oct. 8, 2020.

* cited by examiner

COMPRESSOR STATOR

TECHNICAL FIELD

The application relates generally to compressors and fans of gas turbine engines and, more particularly, to stator vanes for such compressors and fans.

BACKGROUND OF THE ART

In a gas turbine engine, stator blades are designed to provide the best efficiency at the aerodynamic design point. At lower rotating speeds, efficiency typically decreases and reduces the operable range of the compressor and/or the fan.

SUMMARY

In one aspect, there is provided a stator having a central axis, the stator comprising: vanes circumferentially distributed around the central axis, the vanes extending between a first end and a second end along a span and from a leading edge to a trailing edge along a chord length, the vanes having a first end portion extending from the first end to about 30% of the span to a first location, a chord ratio of the chord length at the first end to the chord length at the first location greater than or equal to 1.1, a throat ratio of a width of a throat between two adjacent vanes at the first location to a width of the throat at the first end is greater than or equal to 1.3, a sweep angle difference between a maximum sweep angle of the leading edge along the first end portion and a minimum sweep angle of the leading edge along the first end portion is at least 15 degrees.

In another aspect, there is provided a stator having a central axis, comprising: vanes circumferentially distributed around the central axis, each of the vanes extending between a first end and a second end along a span and from a leading edge to a trailing edge along a chord length, flow passages defined between each of two adjacent ones of the vanes, each of the flow passages having a length extending parallel to the chord length of the vanes and a throat having a width extending between the two adjacent ones of the vanes, a length ratio of the length at the first end to the length at about 30% of the span from the first end greater than or equal to 1.1; a throat ratio of the width of the throat at about 30% of the span from the first end to the width of the throat at the first end greater than or equal to 1.3, and a sweep angle difference between a maximum sweep angle of the leading edge and a minimum sweep angle of the leading edge between the first end and about 30% of the span being at least 15 degrees.

DESCRIPTION OF THE DRAWINGS

Reference is now made to the accompanying figures in which.

DETAILED DESCRIPTION

Figure 1:
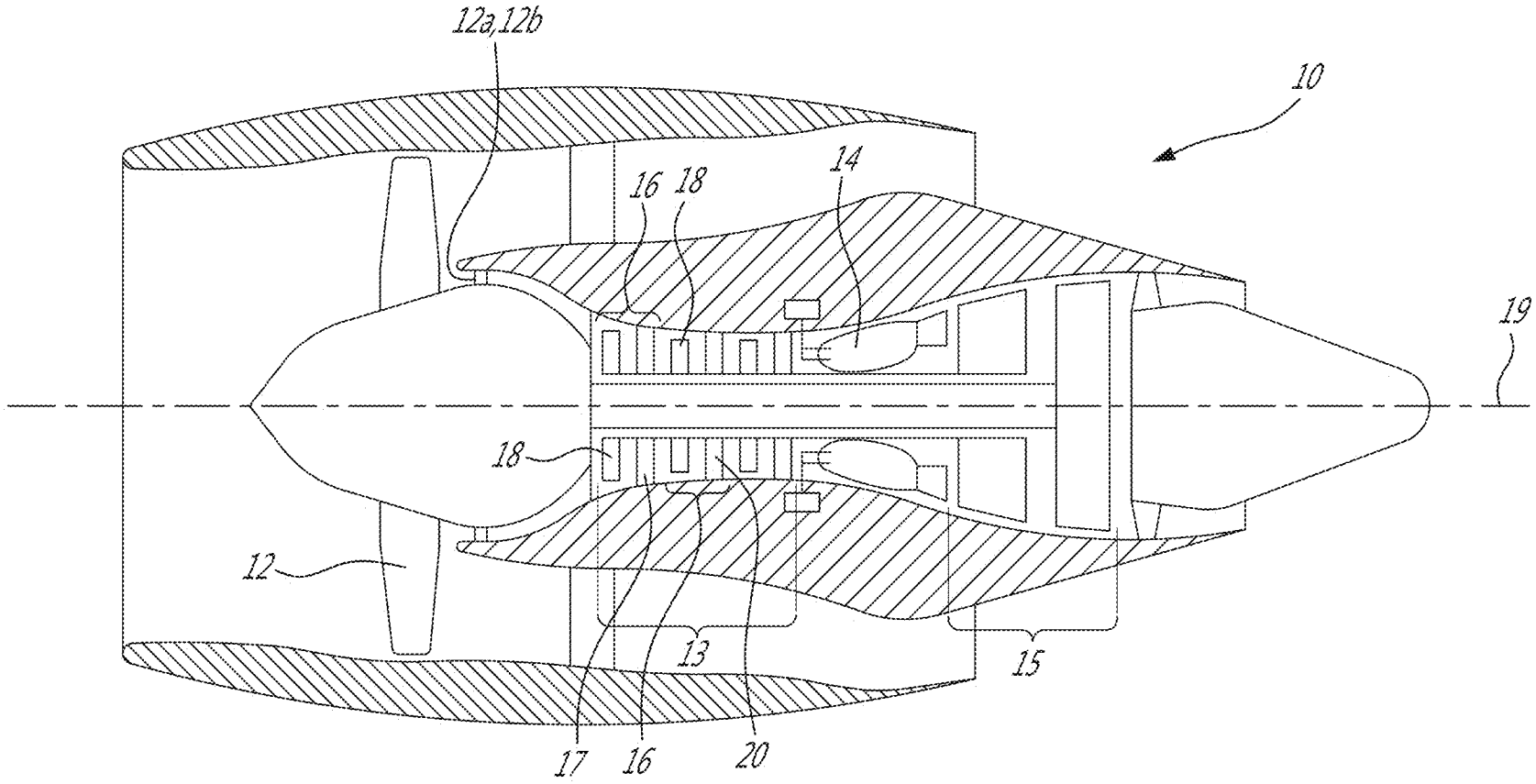
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor 13 for pressurizing the air, a combustor 14 in which the compressed air is mixed with fuel and ignited for generating an annular stream of hot combustion gases, and a turbine section 15 for extracting energy from the combustion gases. In the embodiment shown, a fan core stator 12*a* is located downstream of the fan 12 and upstream of the compressor section 13.

The compressor 13 includes one or more axial compressor stages 16. Each compressor stage 16 includes one or more rows of compressor stators 17 located immediately downstream of a row of compressor rotors 18. Each compressor stator 17 is a non-rotating component that guides the flow of pressurized air towards and from the compressor rotors 18. The compressor rotors 18 rotate about a longitudinal center axis 19 of the gas turbine engine 10 to perform work on the air.

Each compressor stator 17 has a plurality of stator vanes 20. The fan core stator 12*a* includes a plurality of stator vanes 12*b*. Each stator vane 20, 12*b* is a stationary body that diffuses the airflow impinging thereon, thereby converting at least some of the kinetic energy of the incoming airflow into increased static pressure. Each stator vane 20 also redirects the airflow toward the next downstream compressor rotor 18. The stator vanes 12*b* of the fan core stator 12*a* redirect the airflow toward the compressor 13.

Figure 2:
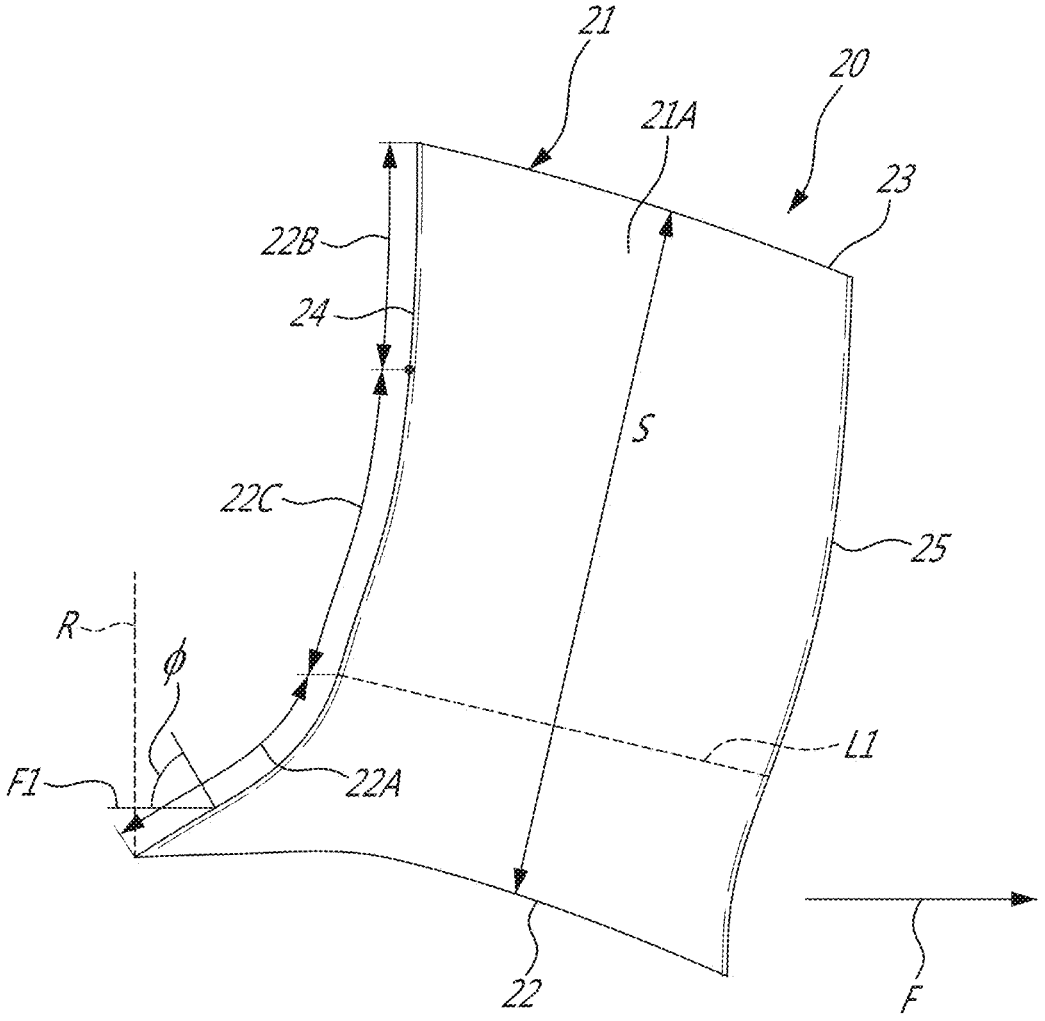
FIG. 2 is a side view of a stator vane of a compressor of the gas turbine engine of FIG. 1.
Figure 3:
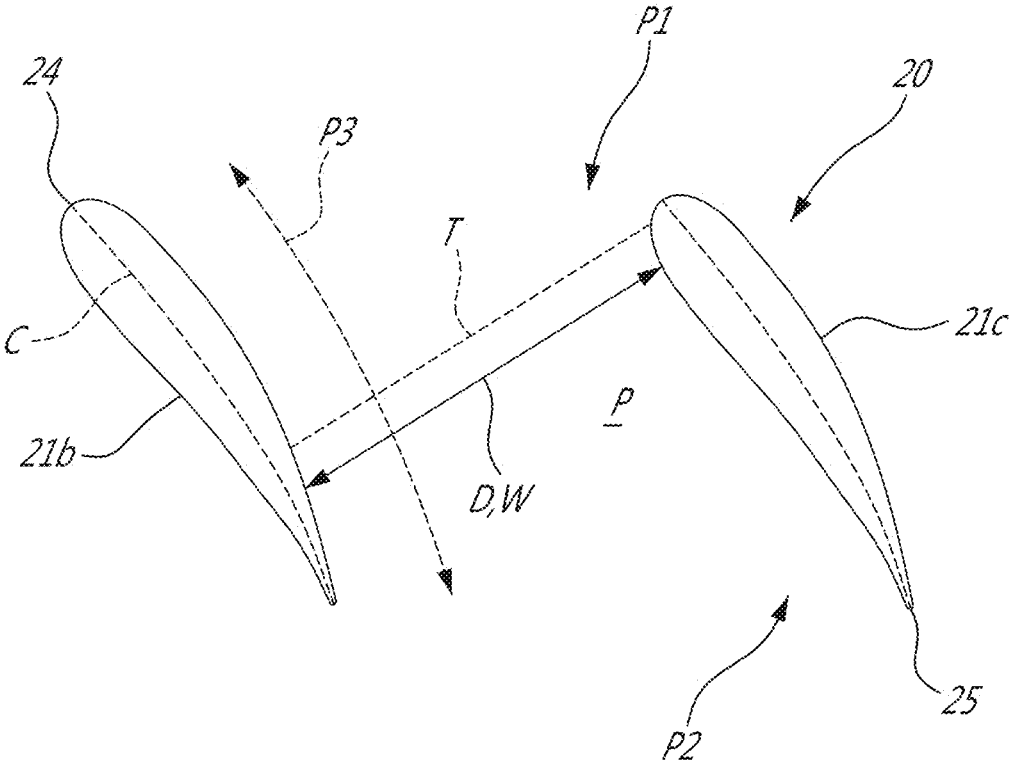
FIG. 3 is a cross-sectional view of two consecutive stator vanes of the compressor of the gas turbine engine of FIG. 1 taken in a radial plane relative to a central axis of the gas turbine engine of FIG. 1.

Referring to FIGS. 2 and 3, each stator vane 20 has an airfoil 21 shaped and sized to effect the above-describe functionality. More details are presented herein below in this respect. Although the below description focuses on the stator vane 20 of the compressor 13, it may apply to the vanes 12*b* of the fan core stator 12*a*.

The airfoil 21 has a body 21A including opposed pressure and suction sides 21B, 21C. The airfoil 21 also includes a root 22 disposed adjacent to a radially inner hub or shroud of the compressor stator 17, and a distal tip 23 disposed adjacent to an outer shroud of the compressor stator 17. A chord length C of the airfoil 21 is defined between a leading edge 24 of the airfoil 21, and a trailing edge 25 of the airfoil 21. In the depicted embodiment, the chord length C is the length of the chord line, which may be thought of as a straight line connecting the leading and trailing edges 24,25. In a particular embodiment, the chord is a line extending from the leading edge 24 to the trailing edge 25 and between the pressure and suction side 21*b*, 21*c*. The chord length C of the vane 20 may vary in function of a spanwise location on the vane 20. That is, the chord length C may vary from the root 22 to the tip 23 of the vane 20. The airfoil 21 extends at least in the radial direction (i.e. in a direction that generally extends parallel to a radial line from the center axis 19 of the gas turbine engine 10) from the root 22 to the tip 23 along a span S.

The airfoil 21 is conceptually divided into stacked radial segments (not shown). The airfoil 21 can be defined as having a radially inner portion 22A adjacent to the root 22 of the airfoil 21 and extending generally radially outwardly therefrom, a radially outer portion 22B adjacent to the tip 23 of the airfoil 21 and extending generally radially inwardly therefrom, and an intermediate portion 22C extending between the inner and outer portions 22A,22B.

Referring more particularly to FIG. 2, the vane 20 defines a sweep angle ϕ. The sweep angle at a given spanwise location is defined as the angle between a line tangent to the leading edge at the given spanwise location and the direction F1 of the incoming flow, minus 90 degrees. A forward sweep is positive and a backward sweep is negative. The sweep angle ϕ of the vane 20 may vary from the root 22 to the tip 23.

Referring more particularly to FIG. 3, two consecutive ones of the vanes 20 are shown in cross-sections taken in a plane normal to the radial direction R (FIG. 2). A flow passage P is defined between the two vanes 20. The flow passage P has an inlet P1 at the leading edges 24 of the two consecutive ones of the vanes 20 and an outlet P2 at the trailing edges of said vanes 20.

A width W of the flow passage corresponds to a distance D between the two vanes 20, that is between the suction side 21*c* of one of the two vanes 20 and the pressure side 21*b* of the other of the two vanes 20. The distance D varies from the leading edge 24 to the trailing edge 25 and may reach a minimal value at a throat T of the flow passage P. Stated differently, in the depicted embodiment, the flow passage P is a converging-diverging passage. In some cases, the throat is located at about 25% of the chord length C from the leading edge 24. It is understood that a position of the throat between the leading and trailing edges 24, 25 may vary from the root 22 and the tip 23 of the vane 20.

The vanes 12*b*, 20 are optimized to provide the best efficiency at the aerodynamic design point. At lower rotational speed of the fan 12 or compressor 13 (FIG. 1), the stator 12*a*, 17 might see an increase in incidence. This phenomenon is particularly present near root of the vanes 12*b*, 20. The increase in incidence might induce flow separation that might reduce the operable range of the compressor. The disclosed vane 12*b*, 20 might enhance performance of the fan 12 and compressor 13 by controlling stator end wall section chord and incidence.

Figure 4:
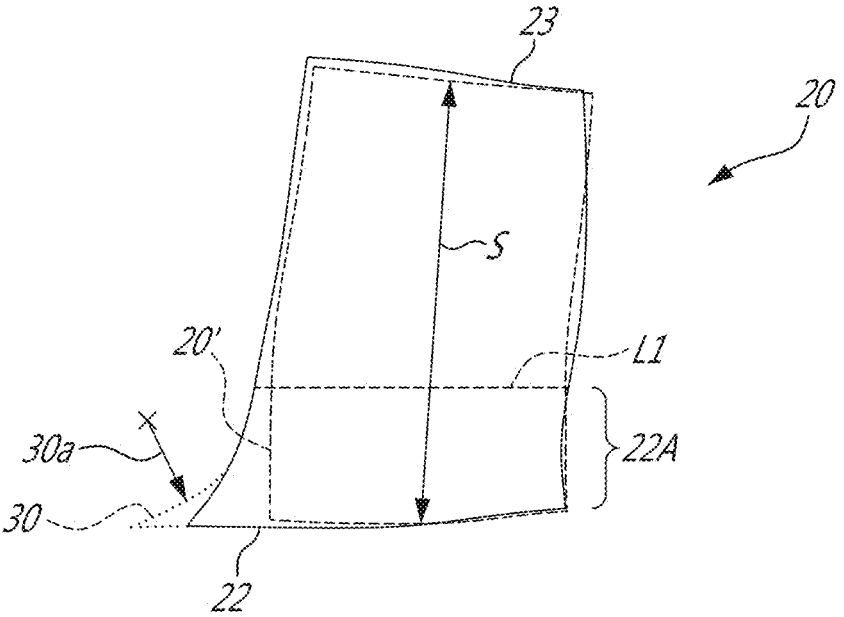
FIG. 4 are contours of the stator vane of FIG. 2 (solid line) and of a baseline configuration of a stator vane (tiered line)

Referring temporarily to FIG. 4, a contour of the vane 20 (which may alternatively correspond to a contour of the vane 12*b* of the fan core stator 12*a*) of FIG. 2 is shown in solid line over a baseline vane 20' to illustrate differences in their respective contours. As shown in FIG. 4, the radially inner portion 22A of the vane 20 is modified. Such a modification might address the aforementioned drawbacks. It is understood that the features of the radially inner portion 22A of the vane 20 described herein below may apply to the radially outer portion 22B of the vane 20. In a particular embodiment, a vane may have the features of the radially inner portion 22A of the vane 20 described below at both of the radially inner and outer portions 22A, 22B. Herein, the geometry of the vane 20 is modified near the end wall compared to a baseline vane 20' by increasing the incidence and the chord.

Referring to FIGS. 2-4, in the embodiment shown, the radially inner portion 22A of the vane 20 ends at a spanwise location L1 between the root 22 and the tip 23 of the vane 20. In the embodiment shown, the spanwise location L1 is located at about 30% of the span S from the root 22 of the vane 20. The radially inner portion 22A may extend from the root 22 to from about 20% to about 30% of the span S. The radially inner portion 22A may extend from the root 22 to at most 30% of the span S. In a particular embodiment, the radially inner portion 22A extends from the root 22 to about 25% of the span.

In a particular embodiment, the radially inner portion 22A extends from the root 22 of the vane 20 to about a third of the span S of the vane 20. In particular embodiment, the radially inner portion of the vane 20 does not include a fillet portion of the vane 20. In a particular embodiment, the fillet portion of the vane 20 extends from the root 22 to about 5% of the span S of the vane 20. The fillet portion of the vane 20 may extend from the root 22 to 20% span. In a particular embodiment, the radially inner portion of the vane 20 extends from about 0% of the span S from the root 22 to about a 30% of the span S from the root S. In a particular embodiment, the radially inner portion of the vane 20 extends from about 5% of the span S from the root 22 to about 30% of the span S of the root S. In a particular embodiment, the radially inner portion 22A extends from about 5% of the span S to from 20% to 30% of the span S.

Herein, the expression "about X" means that "X" varies more or less 20% of "X", that is from X−0.2X to X+0.2X. For example, about 25% means that a value of from 20% to 30% is considered.

In the embodiment shown, a chord ratio of the chord length C of the vane 20 at the root 22 to the chord length C at the spanwise location L1 is greater than or equal to 1.1. In the embodiment shown, the chord ratio is 1.17. The chord ratio may be from 1.1 to about 1.5. In other words, a length ratio of a length P3 of the flow passage P at the root 22 to the length at about 30% of the span S from the root 22 is greater than or equal to 1.1. In the embodiment shown, the length ratio is 1.17. The length ratio may be from 1.1 to about 1.5.

In some cases, a fillet 30 (shown in dotted line in FIG. 4) between the root 22 of the airfoil 21 and a vane platform (not shown) may optionally be added for stress reduction or other purposes. The fillet 30 may be located at the tip to intersect with a shroud. The vane 20 may include a fillet at its tip 23 and a fillet at its root 22. The fillet 30 has a fillet radius 30*a*. In such a case, an effective chord at the root 22 is calculated. The effective chord at the root 22 corresponds to the chord C at the root 22 including the fillet 30 minus two times the radius 30*a* of the fillet 30. In other words, when a fillet is present, the chord ratio is calculated using the effective chord at the root 22.

In the embodiment shown, a throat ratio of the width W of the throat T between the two adjacent ones of the vanes 20 at the spanwise location L1 to the width W of the throat T at the root 22 is greater than or equal to 1.3. The throat ratio may be at least 1.3, preferably at least 1.5. The throat ratio may be at most 3. When a fillet is present, an effective throat width at the root 22 is calculated. The effective throat width at the root 22 corresponds to the throat width at the root 22 including the fillet minus two times the radius 30*a* of the fillet 30. In other words, when a fillet is present, the throat ratio is calculated using the effective throat width at the root 22.

In the embodiment shown, along the radially inner portion 22A, a sweep angle difference between a maximum value of the sweep angle ϕ and a minimum value of the sweep angle ϕ is at least 15 degrees. The sweep angle difference may be greater than 20 degrees. The sweep angle difference may be greater than 25 degrees. In the depicted embodiment, the sweep angle difference is 27 degrees. The sweep angle difference may be at most about 50. In a particular embodiment, the sweep angle difference is at most 90 degrees.

Different graphs illustrating the chord length ratio, the sweep angles ϕ, and the throat ratio are described herein below. All spanwise distances listed below are expressed in percentage of the span S and extends from the root 22 of the vane 20.

Figure 5:
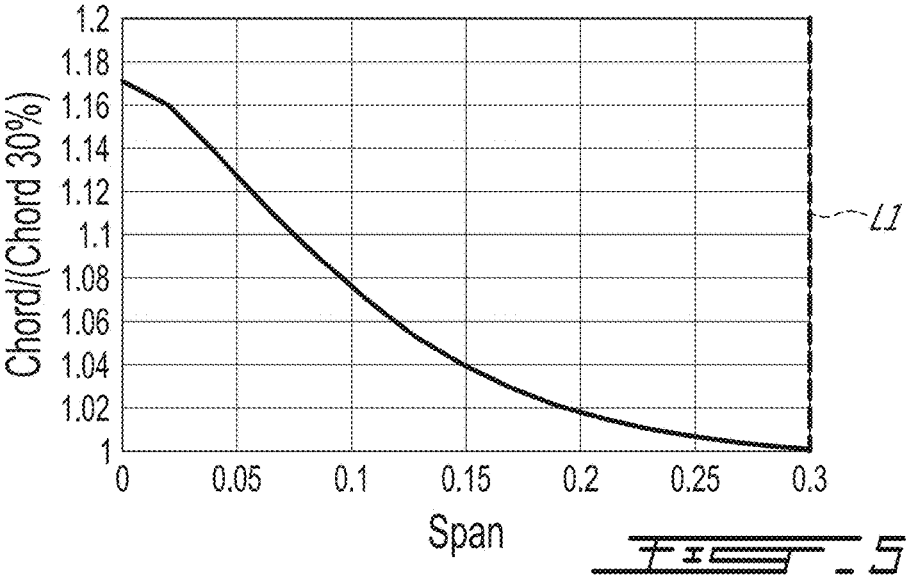
FIG. 5 is a graph illustrating a variation of a ratio of a chord length of the vane of FIG. 2 to a chord length of said vane at a distance of 30% of a span from a root of the vane in function of a spanwise location on the vane (0: root; 0.3: 30% span)

Referring now to FIG. 5, a graph illustrating a variation of the chord length ratio in function of a spanwise position on the vane 20 from the root 22 (span=0) to the spanwise location L1 is shown. As illustrated, the chord length ratio is about 1.17 at the root 22 and decreases to 1 at 30% span. That is, the chord length C of the vane 20 at the root 22 is greater than that at the spanwise location L1. In the depicted embodiment, the chord length C decreases from the root 22 to the tip 23 of the vane 20. As illustrated in FIG. 5, a rate of change of the chord length ratio decreases (in absolute value) from the root 22 to the spanwise location L1 (shown in tiered line).

Still referring to FIG. 5, the chord length C of the vane 20 is greater than the chord length C at the spanwise location L1 between the root 22 and the spanwise location L1.

Figure 6:
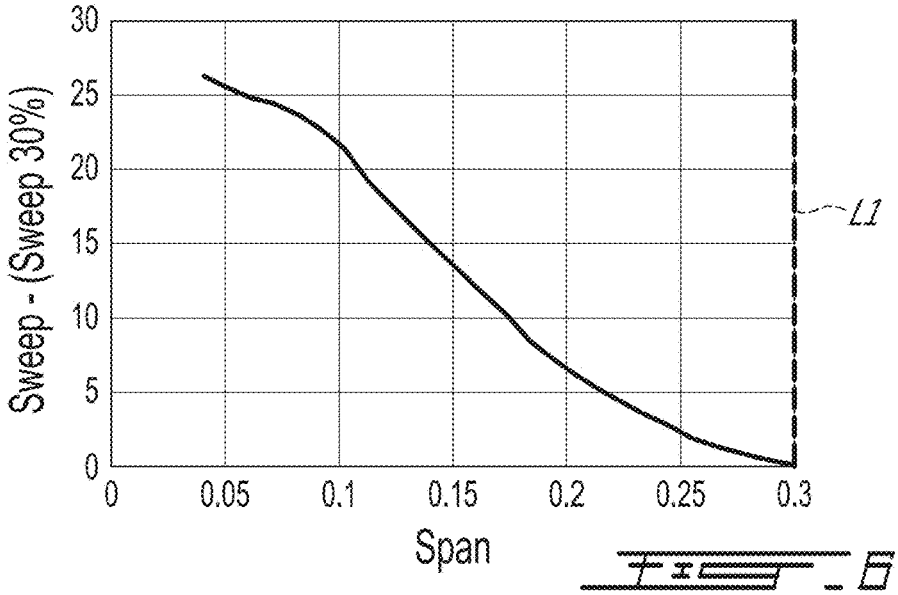
FIG. 6 is a graph illustrating a variation of a difference between a sweep angle of a leading edge of the vane of FIG. 2 and a sweep angle of the leading edge of the vane at a distance of 30% of the span of the vane from the root of the vane in function of the spanwise location on the vane (0: root; 0.3: 30% span)

Referring now to FIG. 6, a graph illustrating a variation of the difference between the sweep angle ϕ of the leading edge 24 and the sweep angle ϕ of the leading edge 24 at the spanwise location L1 is shown. As illustrated, the difference in the sweep angles ϕ is about 27 degrees at about 5% span and decreases to 0 degree at 30% span. A rate of change of the sweep angle is the greatest (in absolute value) from about 10% span to about 25% span. In the embodiment shown, the sweep angle is the greatest at about 5% span and decreases monotonically and abruptly from the root to the spanwise location L1.

Still referring to FIG. 6, the sweep angle ϕ of the leading edge 24 of the vane 20 is greater than the sweep angle ϕ of the leading edge 24 at the spanwise location L1 between the root 22 and the spanwise location L.

Figure 7:
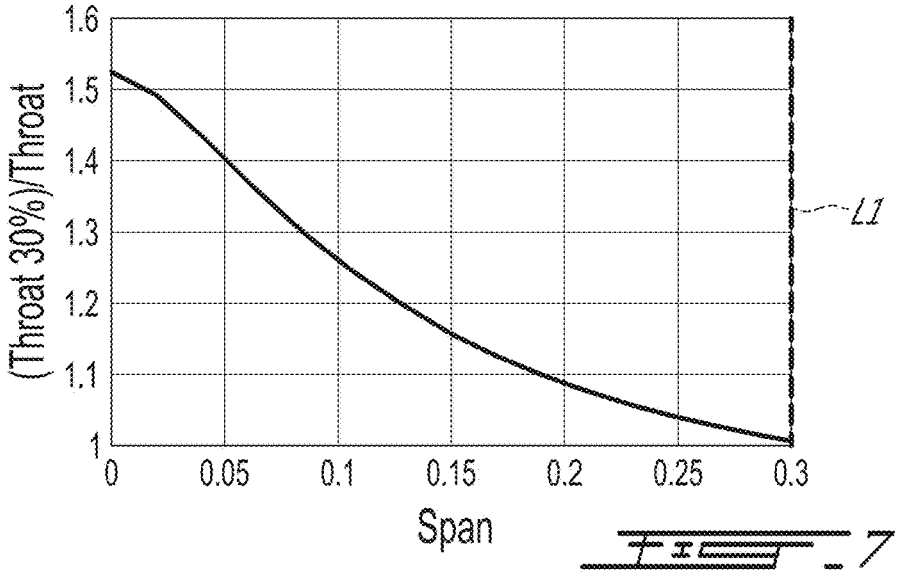
FIG. 7 is a graph illustrating a variation of a ratio of a throat width between two of the vanes of FIG. 2 at a distance of 30% of the span of the vane from the root of the vane to a throat width between the two of the vanes in function of the spanwise location on the vane (0: root; 0.3: 30% span).

Now referring to FIG. 7, a graph illustrating a variation of the throat ratio in function of a spanwise position on the vane 20 from the root 22 (span=0) to the spanwise location L1 is shown. As illustrated, the throat ratio is about 1.525 at the root 22 and decreases therefrom. That is, the width W of the throat T at the root 22 is substantially less than that at the spanwise location L1. In other words, the width W of the throat T at the spanwise location L1 is greater than that at the root 22. A rate of change of the throat ratio decreases (in absolute value) from the root 22 to the spanwise location L1.

It is understood that although the above focused on modification to the radially inner portion 22A of the vane 20, the same modification may be applied to the radially outer portion 22B. In a particular embodiment, the above described chord ratio, throat ratio, and sweep angle differences are applied to the radially outer portion 22B of the vane 20. In a particular embodiment, the above described chord ratio, throat ratio, and sweep angle differences are applied to both of the radially outer portion 22B and the radially inner portion 22A of the vane 20. All of the vanes 20 of the stator 17 may have the same shape. The above described chord ratio, throat ratio, and sweep angle differences may be applied to radially inner portions and/or radially outer portions of the vanes 12*b* of the fan core stator 12*a*. All of the stators 17 of the compressor 13 may have vanes as described above.

In a particular embodiment, the vane 20 reduces flow separation near hub or shroud compared to the baseline vane 20'. The impact of this change might be the highest for low speed when the incidence on the stator 12*a*, 17 is the highest. In a particular embodiment, the above described geometric changes improve the performance of the vane 12*b*, 20. The surge/stall margin might be increased a mid-speed, design speed, and at over speed. The pressure coefficients of the blades located downstream of the vane 12*b*, 20 might be greatly improved by the above described geometric changes. The modification might not impact the efficiency at design speed. The above described vane 12*b*, 20 may reduce flow separation and hub vortex.

Embodiments disclosed herein include:

A. A stator having a central axis, the stator comprising: vanes circumferentially distributed around the central axis, the vanes extending between a first end and a second end along a span and from a leading edge to a trailing edge along a chord length, the vanes having a first end portion extending from the first end to about 30% of the span to a first location, a chord ratio of the chord length at the first end to the chord length at the first location greater than or equal to 1.1, a throat ratio of a width of a throat between two adjacent vanes at the first location to a width of the throat at the first end is greater than or equal to 1.3, a sweep angle difference between a maximum sweep angle of the leading edge along the first end portion and a minimum sweep angle of the leading edge along the first end portion is at least 15 degrees.

B. A stator having a central axis, comprising: vanes circumferentially distributed around the central axis, each of the vanes extending between a first end and a second end along a span and from a leading edge to a trailing edge along a chord length, flow passages defined between each of two adjacent ones of the vanes, each of the flow passages having a length extending parallel to the chord length of the vanes and a throat having a width extending between the two adjacent ones of the vanes, a length ratio of the length at the first end to the length at about 30% of the span from the first end greater than or equal to 1.1; a throat ratio of the width of the throat at about 30% of the span from the first end to the width of the throat at the first end greater than or equal to 1.3, and a sweep angle difference between a maximum sweep angle of the leading edge and a minimum sweep angle of the leading edge between the first end and about 30% of the span being at least 15 degrees.

Embodiments A and B may have any of the following elements in any combinations:

Element 1: the chord ratio is at least 1.17. Element 2: the chord ratio is at most 1.5. Element 3: the sweep angle difference is greater than 20 degrees. Element 4: the sweep angle difference is greater than 25 degrees. Element 5: first location is located at most at 30% of the span from the first end. Element 6: the throat ratio is greater than or equal to 1.5. Element 7: the throat ratio is at most 3. Element 8: the sweep angle difference is at most 90 degrees. Element 9: wherein the first end is a radially inner end of the vane. Element 10: the first end is a radially outer end of the vane. Element 11: each of the vanes has a second end portion extending from the second end along about 30% of the span to a second location, the chord ratio of the chord length at the second end to the chord length at the second location greater than or equal to 1.1; the throat ratio of the width of the throat between the two adjacent ones of the vanes at the second location to the width of the throat at the second end greater than or equal to 1.3; and, along the second end portion, a difference between a maximum sweep angle of the leading edge and a minimum sweep angle of the leading edge being at least 15 degrees The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A compressor stator having a central axis, the compressor stator comprising: vanes circumferentially distributed around the central axis, a vane of the vanes extending between a first end and a second end along a span and from a leading edge to a trailing edge along a chord length, the vane having a first end portion extending from the first end to about 30% of the span to a first location, a chord ratio of the chord length at the first end to the chord length at the first location greater than or equal to 1.1, a throat ratio of a width of a throat between two adjacent vanes at the first location to a width of the throat at the first end is greater than or equal to 1.3, the throat extends from the leading edge of the vane to a suction side of an adjacent one of the vanes, and a sweep angle difference between a maximum sweep angle of the leading edge along the first end portion and a minimum sweep angle of the leading edge along the first end portion is at least 15 degrees.

2. The compressor stator of claim 1, wherein the first end is a radially inner end of the vane.

3. The compressor stator of claim 1, wherein the first end is a radially outer end of the vane.

4. The compressor stator of claim 1, wherein the vane has a second end portion extending from the second end along about 30% of the span to a second location, the chord ratio of the chord length at the second end to the chord length at the second location greater than or equal to 1.1; the throat ratio of the width of the throat between the two adjacent vanes at the second location to the width of the throat at the second end greater than or equal to 1.3; and, along the second end portion, a difference between a maximum sweep angle of the leading edge and a minimum sweep angle of the leading edge being at least 15 degrees.

5. The compressor stator of claim 1, wherein the chord ratio is at least 1.17.

6. The compressor stator of claim 1, wherein the chord ratio is at most 1.5.

7. The compressor stator of claim 1, wherein the sweep angle difference is greater than 20 degrees.

8. The compressor stator of claim 7, wherein the sweep angle difference is greater than 25 degrees.

9. The compressor stator of claim 1, wherein the first location is located at most at 30% of the span from the first end.

10. The compressor stator of claim 1, wherein the throat ratio is greater than or equal to 1.5.

11. The compressor stator of claim 1, wherein the throat ratio is at most 3.

12. A compressor stator having a central axis, comprising: vanes circumferentially distributed around the central axis, a vane of the vanes extending between a first end and a second end along a span and from a leading edge to a trailing edge along a chord length, flow passages defined between each of two adjacent ones of the vanes, a flow passage of the flow passages having a length extending parallel to the chord length of the vane and a throat having a width extending between the two adjacent ones of the vanes, a length ratio of the length at the first end to the length at about 30% of the span from the first end greater than or equal to 1.1; a throat ratio of the width of the throat at about 30% of the span from the first end to the width of the throat at the first end greater than or equal to 1.3, the throat extends from the leading edge of the vane to a suction side of an adjacent one of the vanes, and a sweep angle difference between a maximum sweep angle of the leading edge and a minimum sweep angle of the leading edge between the first end and about 30% of the span being at least 15 degrees.

13. The compressor stator of claim 12, wherein the first end is a radially inner end of the vane.

14. The compressor stator of claim 12, wherein the first end is a radially outer end of the vane.

15. The compressor stator of claim 12, wherein the length ratio is at least 1.17.

16. The compressor stator of claim 12, wherein the length ratio is at most 1.5.

17. The compressor stator of claim 12, wherein the sweep angle difference is greater than 25 degrees.

18. The compressor stator of claim 12, wherein the sweep angle difference is at most 90 degrees.

19. The compressor stator of claim 12, wherein the throat ratio is greater than or equal to 1.5.

20. The compressor stator of claim 12, wherein the throat ratio is at most 3.

* * * * *